US005983410A

United States Patent [19]

Webster

[11] Patent Number: 5,983,410

[45] Date of Patent: Nov. 16, 1999

[54] TOILET BACKSPLASH AND OVERSPRAY SHIELD

[76] Inventor: Carla A. Webster, 12 Colonial Ave. #2, Dorchester, Mass. 02124

[21] Appl. No.: 09/244,389

[22] Filed: Feb. 4, 1999

[51] Int. Cl.[6] ..... E03D 9/00

[52] U.S. Cl. ..... 4/300.3; 4/DIG. 5

[58] Field of Search ..... 4/300.3, DIG. 5, 4/300, 457, 580, 654, 237

[56] References Cited

U.S. PATENT DOCUMENTS

| | | | |
|---|---|---|---|
| 1,618,032 | 2/1927 | Wilkes | 4/DIG. 5 |
| 2,839,764 | 6/1958 | Gardner | 4/DIG. 5 |
| 4,716,602 | 1/1988 | Brickhouse | 4/DIG. 5 |
| 4,912,784 | 4/1990 | Jacobson et al. | 4/300.3 |
| 5,732,416 | 3/1998 | Albert | 4/DIG. 5 |

*Primary Examiner*—David J. Walczak

[57] ABSTRACT

A toilet backsplash and overspray shield for mounting to the back of a toilet bowl to block urine from spraying and splashing on to the rear portions of the toilet. The toilet backsplash and overspray shield includes a resiliently flexible shield 10 having front and back faces, upper and lower edges, and a pair of side edges extending between the upper and lower edges of the shield. At least one resilient hook is outwardly extended from the back face of the shield. The hook is generally J-shaped and has an elongate shaft and an arcuate tip. The shaft of the hook is coupled to the back face of the shield. The arcuate tip is extended upwards the shaft in a direction towards the upper edge of the shield and has a concavity facing the back face of the shield.

8 Claims, 2 Drawing Sheets

TOILET BACKSPLASH AND OVERSPRAY SHIELD

BACKGROUND OF THE INVENTION

1. Field of the Invention

The present invention relates to toilet backsplash and overspray shields and more particularly pertains to a new toilet backsplash and overspray shield for mounting to the back of a toilet bowl to block urine from spraying and splashing on to the rear portions of the toilet.

2. Description of the Prior Art

The use of toilet backsplash and overspray shields is known in the prior art. More specifically, toilet backsplash and overspray shields heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,216,760; U.S. Pat. No. 2,839,764; U.S. Patent No. Des. 139,221; U.S. Pat. No. 2,407,005; U.S. Pat. No. 5,005,224; and U.S. Pat. No. 4,716,602.

While these devices fulfill their respective, particular objectives and requirements, the aforementioned patents do not disclose a new toilet backsplash and overspray shield. The inventive device includes a resiliently flexible shield 10 having front and back faces, upper and lower edges, and a pair of side edges extending between the upper and lower edges of the shield. At least one resilient hook is outwardly extended from the back face of the shield. The hook is generally J-shaped and has an elongate shaft and an arcuate tip. The shaft of the hook is coupled to the back face of the shield. The arcuate tip is extended upwards the shaft in a direction towards the upper edge of the shield and has a concavity facing the back face of the shield.

In these respects, the toilet backsplash and overspray shield according to the present invention substantially departs from the conventional concepts and designs of the prior art, and in so doing provides an apparatus primarily developed for the purpose of mounting to the back of a toilet bowl to block urine from spraying and splashing on to the rear portions of the toilet.

SUMMARY OF THE INVENTION

In view of the foregoing disadvantages inherent in the known types of toilet backsplash and overspray shields now present in the prior art, the present invention provides a new toilet backsplash and overspray shield construction wherein the same can be utilized for mounting to the back of a toilet bowl to block urine from spraying and splashing on to the rear portions of the toilet.

The general purpose of the present invention, which will be described subsequently in greater detail, is to provide a new toilet backsplash and overspray shield apparatus and method which has many of the advantages of the toilet backsplash and overspray shields mentioned heretofore and many novel features that result in a new toilet backsplash and overspray shield which is not anticipated, rendered obvious, suggested, or even implied by any of the prior art toilet backsplash and overspray shields, either alone or in any combination thereof.

To attain this, the present invention generally comprises a resiliently flexible shield 10 having front and back faces, upper and lower edges, and a pair of side edges extending between the upper and lower edges of the shield. At least one resilient hook is outwardly extended from the back face of the shield. The hook is generally J-shaped and has an elongate shaft and an arcuate tip. The shaft of the hook is coupled to the back face of the shield. The arcuate tip is extended upwards the shaft in a direction towards the upper edge of the shield and has a concavity facing the back face of the shield.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new toilet backsplash and overspray shield apparatus and method which has many of the advantages of the toilet backsplash and overspray shields mentioned heretofore and many novel features that result in a new toilet backsplash and overspray shield which is not anticipated, rendered obvious, suggested, or even implied by any of the prior art toilet backsplash and overspray shields, either alone or in any combination thereof.

It is another object of the present invention to provide a new toilet backsplash and overspray shield which may be easily and efficiently manufactured and marketed.

It is a further object of the present invention to provide a new toilet backsplash and overspray shield which is of a durable and reliable construction.

An even further object of the present invention is to provide a new toilet backsplash and overspray shield which is susceptible of a low cost of manufacture with regard to both materials and labor, and which accordingly is then susceptible of low prices of sale to the consuming public, thereby making such toilet backsplash and overspray shield economically available to the buying public.

Still yet another object of the present invention is to provide a new toilet backsplash and overspray shield which provides in the apparatuses and methods of the prior art some of the advantages thereof, while simultaneously overcoming some of the disadvantages normally associated therewith.

Still another object of the present invention is to provide a new toilet backsplash and overspray shield for mounting to the back of a toilet bowl to block urine from spraying and splashing on to the rear portions of the toilet.

Yet another object of the present invention is to provide a new toilet backsplash and overspray shield which includes a resiliently flexible shield 10 having front and back faces, upper and lower edges, and a pair of side edges extending between the upper and lower edges of the shield. At least one resilient hook is outwardly extended from the back face of the shield. The hook is generally J-shaped and has an elongate shaft and an arcuate tip. The shaft of the hook is coupled to the back face of the shield. The arcuate tip is extended upwards the shaft in a direction towards the upper edge of the shield and has a concavity facing the back face of the shield.

Still yet another object of the present invention is to provide a new toilet backsplash and overspray shield that helps keep a toilet clean and sanitary.

Even still another object of the present invention is to provide a new toilet backsplash and overspray shield that is detachable from the toilet for permitting easy cleaning thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

With reference now to the drawings, and in particular to FIGS. 1 through 4 thereof, a new toilet backsplash and overspray shield embodying the principles and concepts of the present invention will be described.

As best illustrated in FIGS. 1 through 4, the toilet backsplash and overspray shield generally comprises a resiliently flexible shield 10 having front and back faces, upper and lower edges, and a pair of side edges extending between the upper and lower edges of the shield. At least one resilient hook is outwardly extended from the back face of the shield. The hook is generally J-shaped and has an elongate shaft and an arcuate tip. The shaft of the hook is coupled to the back face of the shield. The arcuate tip is extended upwards from the shaft in a direction towards the upper edge of the shield and has a concavity facing the back face of the shield.

Figure 1:
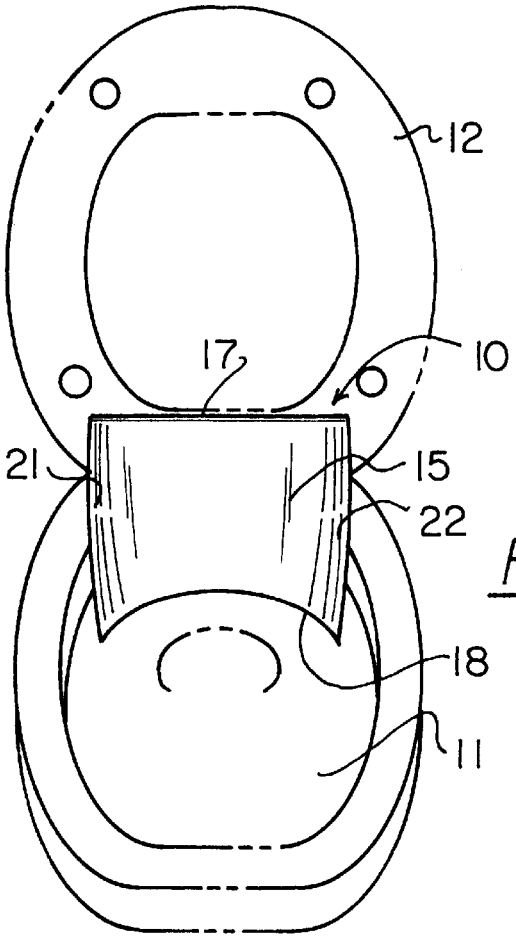
FIG. 1 is a schematic perspective view of a new toilet backsplash and overspray shield attached to a toilet according to the present invention.
Figure 2:
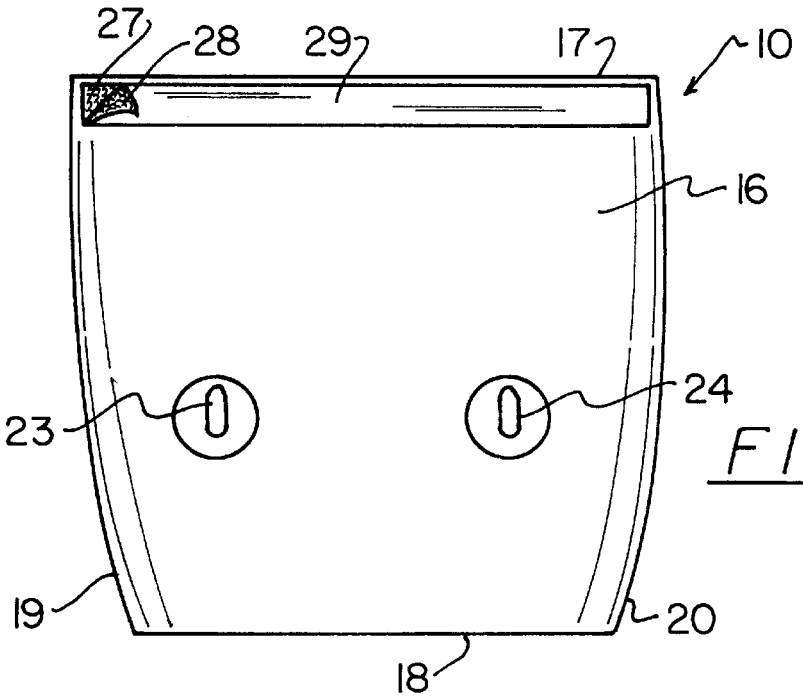
FIG. 2 is a schematic back view of the present invention.

In use, the shield 10 is designed for use with a toilet having a toilet bowl 11, and a toilet seat 12 pivotally mounted above the toilet bowl. The toilet bowl has an upper rim 13 which has an inner ridge 14 therebelow. In closer detail, the shield is resiliently flexible and has front and back faces 15,16, upper and lower edges 17,18, and a pair of side edges extending between the upper and lower edges of the shield. Preferably, the shield comprises a resilient water impermeable plastic material. The upper and lower edges of the shield ideally lie in substantially parallel planes to one another. In this ideal embodiment, the side edges of the shield each have a lower region 19,20 adjacent the lower edge of the shield. As illustrated in FIG. 2, the lower regions of the side edges of the shield converge towards each other in a direction towards the lower edge of the shield.

In use, the shield is positioned adjacent the back region of the toilet bowl to cover the back quarter of the upper rim of the toilet bowl. The back face of the shield faces the back region of the toilet bowl such that the front face of the shield faces in a forwards direction into the toilet bowl. The lower edge of the shield is positioned below the upper rim of the toilet bowl. The upper edge of the shield is positioned about the upper rim of the toilet bowl and adjacent the bottom face of the toilet seat at a rear portion of the toilet seat.

Preferably, the side edges of the shield each have a curved lip 21,22 extending between the upper and lower edges of the shield. The curved lips of the side edges of the shield are outwardly extended from the front face of the shield with the curved lips of the side edges of the shield having concavities facing inwards towards one another. In use, the curved lips are designed for preventing urine striking the front face of the shield from flowing over the side edges of the shield and for directing the urine towards the lower edges of the shield.

The shield has a height defined between the upper and lower edges of the shield and a width defined between the side edges of the shield. Preferably, the height of the shield is between about 3 inches and about 10 inches and the width of the shield is between about 4 inches and about 12 inches. Ideally, the height of the shield is about 5 inches and the width of the shield is about 6 inches.

Figure 3:
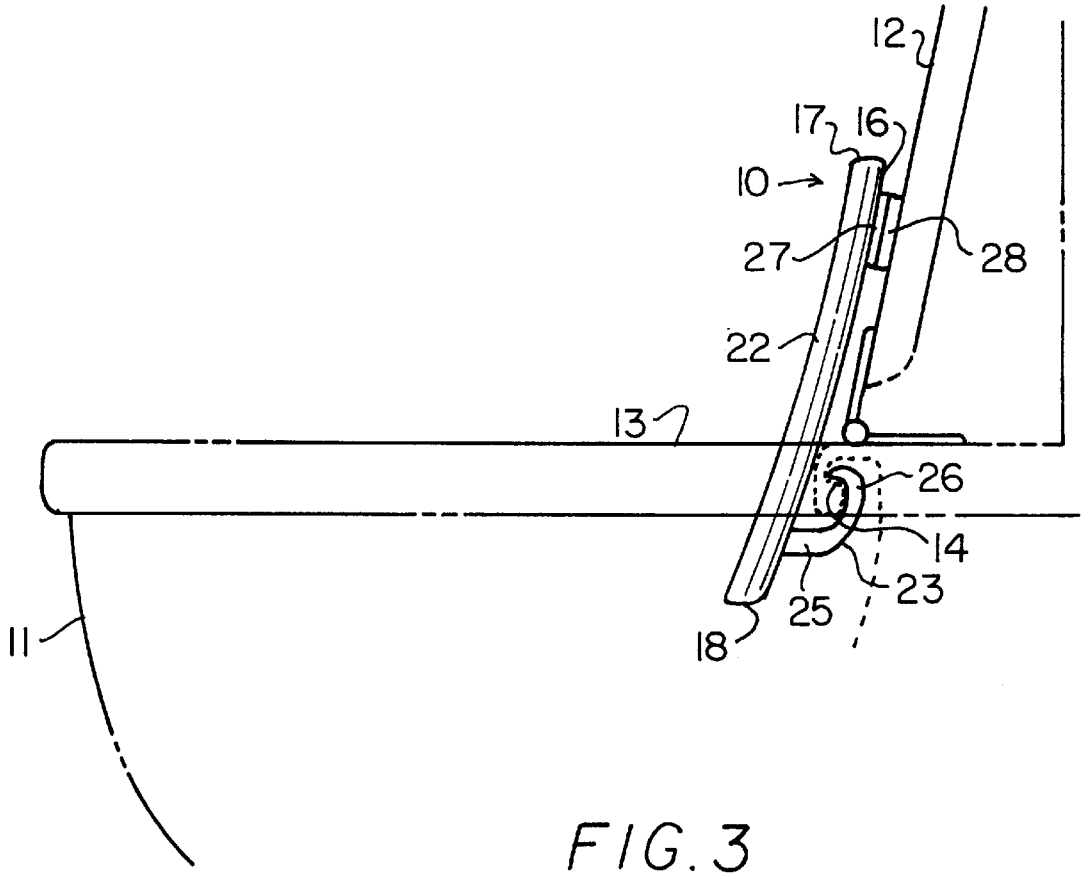
FIG. 3 is a schematic side view of the present invention with the toilet seat in a raised position.
Figure 4:
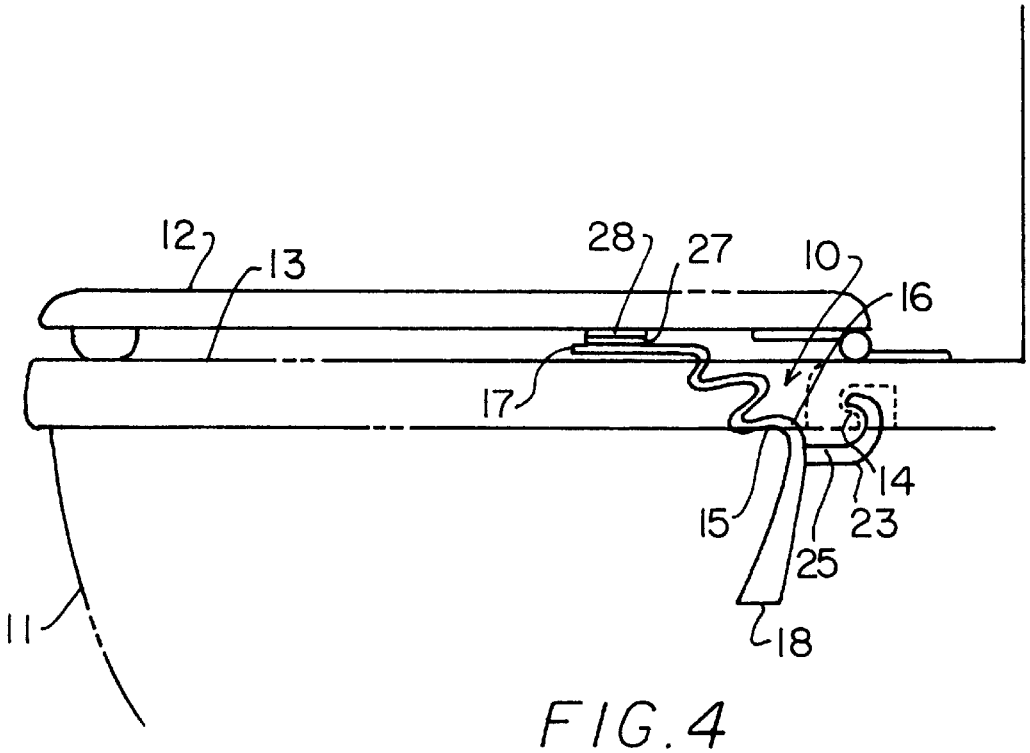
FIG. 4 is a schematic side view of the present invention with the toilet seat in a lowered position.

At least one resiliently deflectable hook 23,24 is outwardly extended from the back face of the shield. The hook is generally J-shaped and has an elongate shaft 25 and an arcuate tip 26. The shaft of each hook is coupled to the back face of the shield. The shaft of each hook is preferably extended generally perpendicular to the back face of the shield. The arcuate tip of each hook is extended upwards from the shaft in a direction towards the upper edge of the shield and has a concavity facing the back face of the shield. As best illustrated in FIGS. 3 and 4, the arcuate tip of each hook is hooked onto the inner ridge of the upper rim of the toilet bowl at the back region of the toilet bowl to hold the shield to the back region of the toilet bowl both when the toilet seat is raised (FIG. 3) and lowered to rest on the upper rim of the toilet bowl (FIG. 4).

The back face of the shield is also attached to the bottom face of the toilet seat adjacent the upper edges of the shield. Preferably, a hook and loop fastener detachably attaches the back face of the shield to the bottom face of the toilet seat so that the shield may be removed from the toilet for easier cleaning of the toilet and the shield. The hook and loop fastener has a pair of complementary portions 27,28 detachably attached to one another. The complementary portions each are provided on a generally rectangular strip. The strip of a first of the complementary portions 27 is provided on the back face of the shield adjacent the upper edge of the shield. As best illustrated in FIG. 2, the strip of the first complementary portion is extended between the side edges of the shield substantially parallel to the upper edge of the shield. The strip of a second of the complementary portions 28 is provided on the bottom face of the toilet scat at the rear region of the toilet seat. Preferably, the strip of the second complementary portion has an adhesive backing 29 adhesively coupling the strip of the second complementary portion to the bottom face of the toilet seat.

In use, when the toilet scat is raised, the shield is positioned to deflect urine from a male user overshooting the toilet bowl back into the toilet bowl and help prevent the exterior of the toilet from becoming soiled. The shield is flexible to permit lowering of the toilet seat. When the toilet seat is lowered, the shield is positioned so that the shield does not obstruct or hinder user of the toilet as illustrated in FIG. 4.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toilet bowl attachment for blocking toilet backsplash and overspray, said attachment comprising:

a resiliently flexible shield having front and back faces, upper and lower edges, and a pair of side edges extending between said upper and lower edges of said shield;

a pair of resilient hooks each hook being outwardly extended from said back face of said shield;

each said hook being generally J-shaped and having an elongate shaft, a medial portion and an arcuate tip, said elongate shaft extending substantially orthogonally outward from said shield, said medial portion extending upwardly from said elongate shaft and turning back towards said shield such that said tip is positioned above said elongate shaft whereby said tip of each said hook is adapted to engage a generally horizontal upper surface of an interior rim of a toilet bowl;

said shaft of said hook being coupled to said back face of said shield; and said arcuate tip being extended upwards from said shaft in a direction towards said upper edge of said shield and having a concavity facing said back face of said shield.

2. The toilet bowl attachment of claim 1, wherein said upper and lower edges of said shield lie in substantially parallel planes to one another.

3. The toilet bowl attachment of claim 2, wherein said side edges of said shield each have a lower region adjacent said lower edge of said shield, said lower regions of said side edges of said shield converging towards each other in a direction towards said lower edge of said shield.

4. The toilet bowl attachment of claim 1, wherein said side edges of said shield each have a curved lip extending between said upper and lower edges of said shield, said curved lips of said side edges of said shield being outwardly extended from said front face of said shield, said curved lips of said side edges of said shield having concavities facing inwards towards one another.

5. The toilet bowl attachment of claim 1, wherein said shield has a height defined between said upper and lower edges of said shield and a width defined between said side edges of said shield, wherein said height of said shield is between about 3 inches and about 10 inches and said width of said shield is between about 4 inches and about 12 inches.

6. The toilet bowl attachment of claim 1, further comprising a hook and loop fastener having a pair of complementary portions detachably attached to one another, said complementary portions each being provided on a generally rectangular strip, said strip of a first of said complementary portions being provided on said back face of said shield adjacent said upper edge of said shield, said strip of said first complementary portion being extended between said side edges of said shield substantially parallel to said upper edge of said shield.

7. The toilet bowl attachment of claim 6, wherein said strip of a second complementary portion has an adhesive backing.

8. A shield system for attachment to a back of a toilet bowl, comprising:

a toilet having a toilet bowl, a toilet seat pivotally mounted above the toilet bowl, the toilet bowl having a back region, an upper rim, and an inner ridge below the upper rim, said toilet seat having top and bottom faces;

a resiliently flexible shield having front and back faces, upper and lower edges, and a pair of side edges extending between said upper and lower edges of said shield;

said upper and lower edges of said shield lying in substantially parallel planes to one another;

said side edges of said shield each having a lower region adjacent said lower edge of said shield, said lower regions of said side edges of said shield converging towards each other in a direction towards said lower edge of said shield;

said side edges of said shield each having a curved lip extending between said upper and lower edges of said shield, said curved lips of said side edges of said shield being outwardly extended from said front face of said shield, said curved lips of said side edges of said shield having concavities facing inwards towards one another;

said shield being positioned adjacent the back region of the toilet bowl, said back face of said shield facing the back region of the toilet bowl, said lower edge of said shield being positioned below the upper rim of the toilet bowl, said upper edge of said shield being positioned about the upper rim of the toilet bowl and adjacent the bottom face of the toilet seat at a rear portion of the toilet seat;

said shield having a height defined between said upper and lower edges of said shield and a width defined between said side edges of said shield;

wherein said height of said shield is between about 3 inches and about 10 inches and said width of said shield is between about 4 inches and about 12 inches;

at least one resilient hook being outwardly extended from said back face of said shield;

said hook being generally J-shaped and having an elongate shaft and an arcuate tip;

said shaft of said hook being coupled to said back face of said shield, said shaft of said hook being extended generally perpendicular to said back face of said shield;

said arcuate tip being extended upwards from said shaft in a direction towards said upper edge of said shield and having a concavity facing said back face of said shield;

said arcuate tip being hooked onto the inner ridge of the upper rim of the toilet bowl at the back region of the toilet bowl;

said back face of said shield being attached to the bottom face of the toilet seat adjacent said upper edge of said shield;

wherein a hook and loop fastener detachably attaches said back face of said shield to said bottom face of said toilet seat;

said hook and loop fastener having a pair of complementary portions detachably attached to one another, said complementary portions each being provided on a generally rectangular strip;

said strip of a first of said complementary portions being provided on said back face of said shield adjacent said upper edge of said shield, said strip of said first complementary portion being extended between said side edges of said shield substantially parallel to said upper edge of said shield;

said strip of a second of said complementary portions being provided on the bottom face of the toilet seat at the rear portion of the toilet seat; and wherein said strip of said second complementary portion has an adhesive backing adhesively coupling said strip of said second complementary portion to the bottom face of the toilet seat.

* * * * *